United States Patent [19]

Umezaki et al.

[11] 4,178,752

[45] Dec. 18, 1979

[54] SHUTTER TYPE DIGITAL CLOCKS

[75] Inventors: Hideo Umezaki; Katsuharu Doma, both of Tokyo; Toshiro Konno, Kawanishi; Fumio Yanashita, Izumi; Yoshio Saito, Kurokawa; Tosuke Sawafuji, Izumi, all of Japan

[73] Assignees: Tamura Electric Works, Ltd., Tokyo; Yanashita Seiko Kabushiki Kaisha, Izumi, both of Japan

[21] Appl. No.: 853,765

[22] Filed: Nov. 21, 1977

[30] Foreign Application Priority Data

| | | | |
|---|---|---|---|
| Nov. 24, 1976 | [JP] | Japan | 51-157802 |
| Dec. 10, 1976 | [JP] | Japan | 51-149091 |
| Dec. 25, 1976 | [JP] | Japan | 51-175078 |
| Mar. 31, 1977 | [JP] | Japan | 52-40524 |

[51] Int. Cl.[2] ..... G04C 17/02

[52] U.S. Cl. ..... 58/126 E; 58/50 R; 58/23 R; 340/764

[58] Field of Search ..... 58/50 R, 50 A, 125 C, 58/126 E; 340/336, 373, 763, 764; 40/450, 451

[56] References Cited

U.S. PATENT DOCUMENTS

| | | | |
|---|---|---|---|
| 3,683,523 | 8/1972 | Boyles | 40/451 |
| 3,683,524 | 8/1972 | Polonsky | 40/451 |
| 3,721,087 | 3/1973 | Boyles | 58/50 R |
| 3,965,668 | 6/1976 | Tomokazu | 58/50 R |

*Primary Examiner*—B. Dobeck
*Assistant Examiner*—William L. Feeney
*Attorney, Agent, or Firm*—Charles E. Pfund

[57] ABSTRACT

The clock comprises a display substrate having hour, ten minutes and minute display members each constituted by a plurality of display digit openings which are arranged in the form of a letter 8, a light diffusion plate situated on the back of the display substrate and formed with a plurality of shutter guide openings corresponding to respective display members, a lamp house block positioned to the rear of the light diffusion plate and provided with a plurality of lamp openings corresponding to respective display members, a plurality of lamps received in the lamp openings, a frame for supporting the display substrate, the light diffusion plate and the lamp house block, a plurality of shutter units positioned to the rear of the lamp house block and extending to the front surface of the light diffusion plate, each shutter unit including a plurality of shutter members cooperating with the display digit openings for selectively opening and closing the same, and a plurality of cam control mechanisms associated with a synchronized digit shift mechanism for controlling the positions of respective shutter members of the shutter units.

17 Claims, 17 Drawing Figures

SHUTTER TYPE DIGITAL CLOCKS

BACKGROUND OF THE INVENTION

This invention relates to a shutter type digital clock. Prior art display devices utilized in the shutter type digital clocks are disclosed, for example, in U.S. Pat. Nos. 3,399,474, 3,683,523, 3,721,087, and 3,965,668.

The display device disclosed in U.S. Pat. No. 3,399,474 comprises four laminated sliding plates each made of an opaque plate, and a plurality of light reflecting layers and slits formed on the surface of the sliding plates. These sliding plates are operated by a suitable operating member to display digits by the light reflecting layers so that it is impossible to construct the display device as an interally illuminated type. Accordingly, the digits are illuminated by the light impinging thereon through openings of a display substrate positioned in front of the sliding plates so that the displayed digits that is the light reflected thereby can been seen in a limited direction and regions. Moreover, the reflected light is vary faint so that it is not only impossible to have brilliant display but also to display when the filament of the illuminating lamp breaks.

To obviate the disadvantages described above display devices as disclosed in U.S. Pat. Nos. 3,683,523 and 3,721,087 have been proposed. The display device shown in these U.S. Patents comprises a display substrate formed with a plurality of display digit openings which are arranged in the form of a letter 8, a shutter plate disposed on the rear side of the substrate in the horizontal direction for opening and closing the display digit openings in the vertical direction and another shutter plate movable in the vertical direction for opening and closing openings in the horizontal direction. Although this display device is advantageous in that it requires only two shutter plates, it is necessary to index the horizontally movably shutter plates to one of 6 positions and to index the vertically movable shutter plate to one of 5 positions. Accordingly, it is necessary to work the cam control mechanism for operating the shutter plates to have extremely high accuracies, and even a small dimensional error causes erroneous display.

The display device disclosed in the applicants U.S. Pat. No. 3,965,668 comprises a display substrate formed with a plurality of display digit openings which are arranged in the form of a letter 8, a first shutter plate positioned to the rear of the display substrate and movable in the vertical direction for opening and closing the display digit openings at the upper and lower sides, a second shutter plate movable in the vertical direction for opening and closing the display digit openings at the middle portion, a third shutter plate movable in the horizontal direction for opening the display digit openings at both upper sides, and a fourth shutter plates movable in the horizontal direction for opening and closing the display digit openings at both lower sides. With this construction, although it is necessary to provide four shutter plates since each shutter plate is required to be indexed to one of at most three positions, there is an advantage of simplifying the construction of the cam control mechanism. However, in any one of the prior art display devices described above where the number of the shutter plates is decreased, the shutter plates overlap with each other on the rear side of the display substrate so that not only the thickness of the display member increases but also the configuration of the digits displayed would be deformed during the coarse of changing the digits. Moreover, in the display device of the type described above wherein a lamp is contained in the display device and leak of light through the digit opening is controlled by the shutter plates, even when respective shutter plates are not positioned on a plane there is no trouble, but when the filament of the lamp breaks or where the ground color of the back plate is used for display, the construction is not advantageous.

SUMMARY OF THE INVENTION

It is an object of this invention to obtain a shutter type digital clock provided with a display device in which a plurality of display digit openings arranged in the form of a letter 8 are opened and closed by a plurality of shutter members each provided for each digit opening.

Another object of this invention is to provide a shutter type digital clock provided with a plurality of shutter members which are supported by simple supporting members that can be readily assembled.

Still another object of this invention is to provide an improved shutter type digital clock provided with a plurality of shutter members each for one of a plurality of display digit openings which are arranged in the form of a letter 8, wherein the shutter members can be classified into only four types and having reasonable construction.

A further object of this invention is to provide a novel shutter type digital clock provided with an internal illuminating means for optically displaying the present time and can continuously display the time even when the filament of the lamp breaks.

According to this invention, these and further objects can be accomplished by providing a shutter type digital clock comprising a display substrate including a plurality display members each formed with a plurality of display digit openings, a light diffusion plate made of a colored synthetic resin containing a phosphor pigment, a lamp house block provided with a plurality of lamp openings corresponding to respective display members of the display substrate, an illuminating device including a plurality of lamps respectively contained in the lamp openings, a frame for supporting various elements described above and provided with a plurality of bearing members, a plurality of shutter units each including a plurality of shutter members corresponding to the display digit openings, each shutter member having a support, a driving member and a shutter piece, a plurality of cam control mechanisms for controlling the positions of respective shutter members and corresponding to respective display members, and a digit shift mechanism interposed between adjacent cam control mechanisms for synchronously shifting the digits from lower to higher orders.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

The accompanying drawings show a display device of a shutter type digital clock designed to be used as a clock or incorporated into a television or radio receiving set. Accordingly, the display device illustrated in FIG. 1 may be provided with a cover, a driving device including a synchronous motor that can be mounted on a right hand side surface, and a time switch that can be mounted on a left hand side surface. However, since these members are not material to this invention, they are not shown and described.

The display device shown in FIG. 1 comprises a frame A, a display member assembly B, a plurality of shutter units C, a control device D including a plurality of cam control mechanisms for controlling the positions of respective shutter members of the shutter units and a digit shift mechanism for synchronously shifting the cam control mechanisms, and an illuminating device E to be described later with reference to FIG. 14. These component elements have unique constructions, and assembled into the clock display device of this invention. In the following description, these component elements will be described successively.

Figure 2:
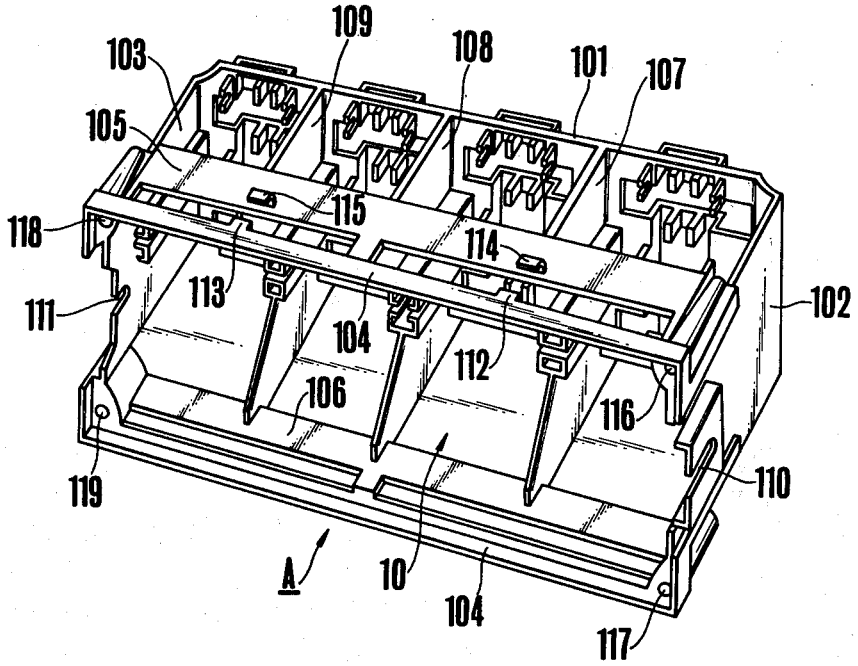
FIG. 2 is a perspective view showing the frame of the display device shown in FIG. 1.
Figure 3:
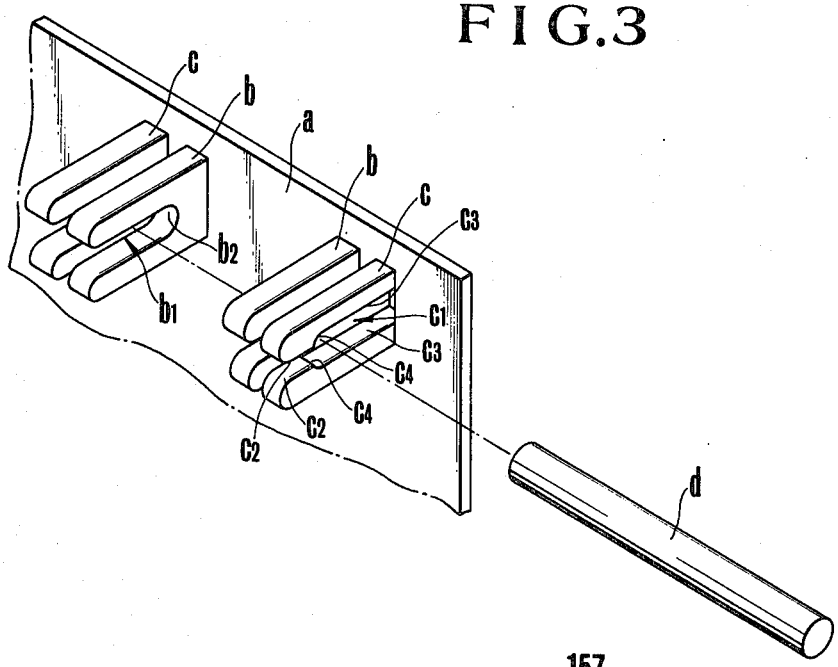
FIG. 3 is a partial perspective view showing bearing members formed on the supporting wall of the display device.

The details of the frame A is shown in FIGS. 2 and 3. As shown in FIG. 2, the frame A comprises an integral frame 10 made of a synthetic resin and including a rear wall 101, side walls 102 and 103 parallelly projecting toward the front side from the rear wall 101, a front frame 104 formed on the front ends of the side walls 102 and 103, beams 105 and 104 positioned close to the front frame 104 and interconnecting the upper and lower edges of the side walls 102 and 103 and partition walls 107, 108 and 109 extending in parallel with the side walls 102 and 103 from the inner surface of the rear wall 101 to the beams 105 and 104, respectively. Accordingly, the frame 10 has four compartments defined by the rear wall 101, side walls 102, 103 and partition walls 107, 108 and 109. Each compartment contains one of a plurality of shutter units C and one of the control members D which are provided for displaying minutes, 10 minutes, hours and ten o'clocks. The rear wall 101 is formed with a plurality of bearing members for journalling the shafts of the rotary cams of the control mechanism for controlling the shutter members of the shutter units C and the positions of the shutter members. Since all bearing members have the same construction, the construction of one of them will be described in detail with reference to FIG. 3. Each bearing member is constituted by two bearing plates b and c which are parallelly projecting from a substrate a corresponding to the rear wall 101. Thus, pairs of bearing plates b and c are provided for supporting the opposite ends of the shaft of a rotary cam. The first bearing plate b is formed with a V shaped notch $b_1$ extending toward substrate a. The bottom of the notch $b_1$ is rounded. The second bearing plate c spaced from bearing plate b by a small distance is also formed with a similar notch $c_1$ which is tapered as at $c_2$ so that the width of the notch $c_1$ increase toward its opened end, while the side walls of the notch near its bottom are straight. The straight portions and the tapered portions are interconnected by arcuate portions $c_4$. When the first and second bearing plates b and c are combined together, a shaft opening which is opened at the free end is defined by the arcuate bottom $b_2$, and the arcuate portions $c_4$. Consequently, when shaft d is forced into the shaft opening from one side thereof, the bearing plates b and c expand and contract in the vertical direction due to their resiliency thus permitting ready mounting of the shaft d. As will be described later, shaft d corresponds to a pin shaft integrally fomed which each shutter member of each shutter unit or the stub shaft of a rotary cam of the cam control mechanism.

Turning back again to FIG. 2, the frame 10 is provided with a support for supporting the digit shift mechanism associated with the cam control mechanism and a member for mounting an illuminating device E to be described later. The digit shift mechanism will be described later with reference to FIG. 6. The opposite ends of the supporting shaft 60 of the digit shift mechanism are received in the horizontal grooves 110 and 111 at the fore ends of the side walls 102 and 103 of the frame, the grooves being opened at substantially the middle portion of the side walls 102 and 103. The movement of the supporting shaft 60 toward the front side is prevented by the rear wall of the lamp house block 17 of the display device assembly B. Rearwardly projecting projections 112 and 113 are integrally provided for the rear edge of the front frame 104. Inverted L shaped projections 114 and 115 are formed on the upper surface of the beam 105 to face the projections 112 and 113 to support the illuminating device shown in FIG. 14. Openings 116, 117, 118 and 119 are formed at respective corners of the front frame 104 for mounting the display device assembly B.

Figure 4:
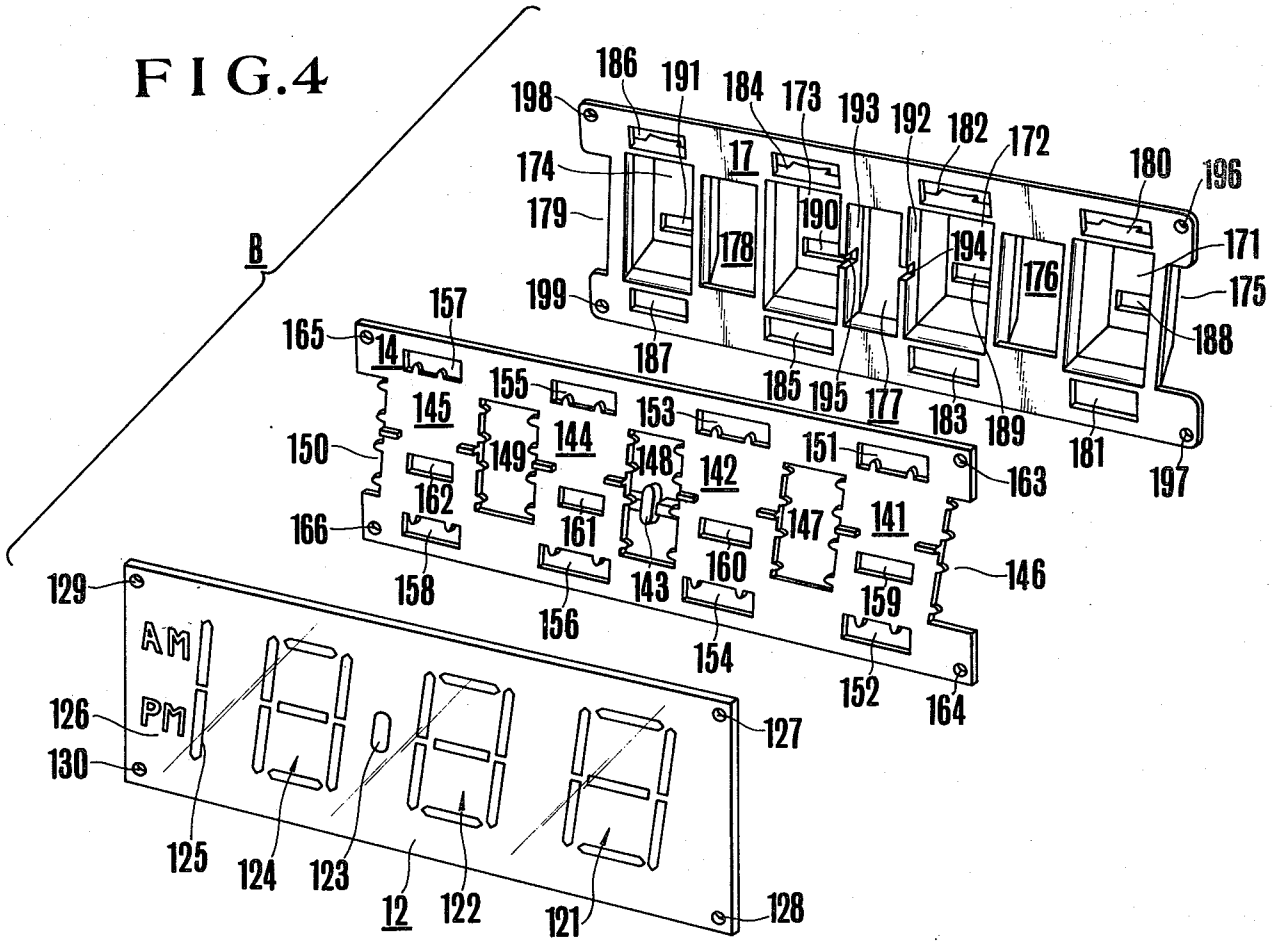
FIG. 4 is an exploded perspective view showing an assembly of the display device shown in FIG. 1 and comprising a display substrate, a light diffusion plate and a lamp house block.

The display device assembly B is constituted by a display substrate 12, a light diffusion plate 14 and a lamp house block 17 which are superposed one upon the other, these members being shown in FIG. 4. The display substrate 12 is made of a transparent acrylic resin plate and the rear surface thereof is screen printed with a black colored ink that intercepts light for forming respective display members including a minute display member 121, a ten minutes display member 122, a hour-minute separating colon 123, a hour display member 124, a ten o'clock display member 125, and an AM, PM letter display member 126. More particularly, each of the minute display member 121, ten minutes display member 122, and hour display member 124 is constituted by seven display digit openings which are arranged in the form of a letter 8 whereas the hour-minute separating colon 123 comprises an elliptical opening and the ten o'clock display member 125 comprises vertically aligned two display digit openings which are arranged in the form of a letter "1". The AM, PM letter display member 126 comprises "AM" and "PM" letter openings which are arranged in the vertical direction. The digit and letter openings and the elliptical opening described above are formed by screen printing. In other words, the portions of the transparent plate corresponding to these openings are not printed with black ink. Perforations 127, 128, 129 and 130 corresponding to the mounting openings 116, 117, 118 and 119 of the front frame 104 are formed near the four corners of the display substrate.

Figure 5:
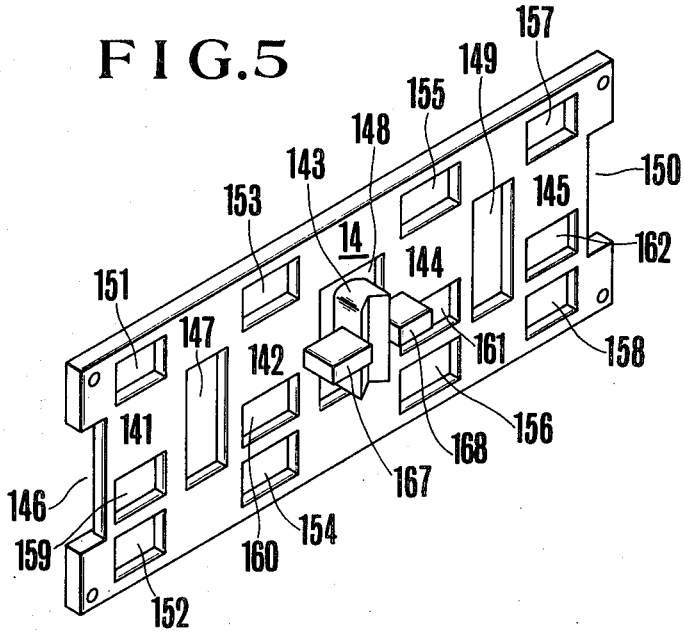
FIG. 5 is a perspective rear view of the light diffusion plate shown in FIG. 4.

The light diffusion plate 14 is made of colored synthetic resin containing a phosphor pigment and having light intercepting property. The color of the light diffusion plate is preferably orange color or bright red color whereas the display substrate is colored black. The light diffusion plate 14 is formed with a minute shielding member 141, a ten minutes shielding member 142 a colon shielding member 143, a hour shielding member 144, and a ten o'clock and AM, PM shielding member 145 corresponding to respective display members 121 through 126. More particularly, the minute shielding member 141 is formed by a portion between a notch 146 formed on one side of the light shielding plate 14 and a vertical opening 147 spaced from the notch 146 by a distance equal to the width of the minute display member 121. In the same manner, the ten minutes display member 142 is formed by a portion between the opening 147 and an opening 148 spaced therefrom by a distance equal to the width of the ten minutes display member 122. The hour shielding member 144 is formed by a portion between openings 148 and 149 whereas the ten o'clock and PM, AM shielding member 145 is formed by a portion between the opening 149 and a notch 150 formed on the other side of the light diffusion plate 14. Respective shielding members 141, 142, 143, 144 and 145 are provided with a pair of horizontal slots 151, 152; 153, 154; 155, 156 and 157, 158 formed near the upper and lower edges of the light shielding plate, and horizontal slots 159, 160, 161 and 162 a little below the central portion. All slots described above act as the guide openings for passing the shutter members of respective shutter units to be described later, and each slot is formed with a plurality of projections for determining the position of the shutter member. Also near the four corners of the light shielding plate 14 are formed perforations 163, 164, 165 and 166 coinciding with the perforations 127, 128, 129 and 130 respectively of the display substrate 12. The colon shielding member 143 has a special construction. More particularly, the member 143 is constituted by an elliptical beam at about the central portion of the opening 148 that separates the ten minutes shielding member and the hour shielding member 144 and when the display device assembly is fabricated, the surface of the beam abuts against the colon display member 123 of the display substrate 12. As shown in FIG. 5, the rear surface of the beam 14 is provided with a pair of legs 167 and 168 facing the rear surface of the 10 minutes shielding member 142 and the hours shielding member 144. These legs cooperate with the lamp house block 17 to be described later.

Figure 8:
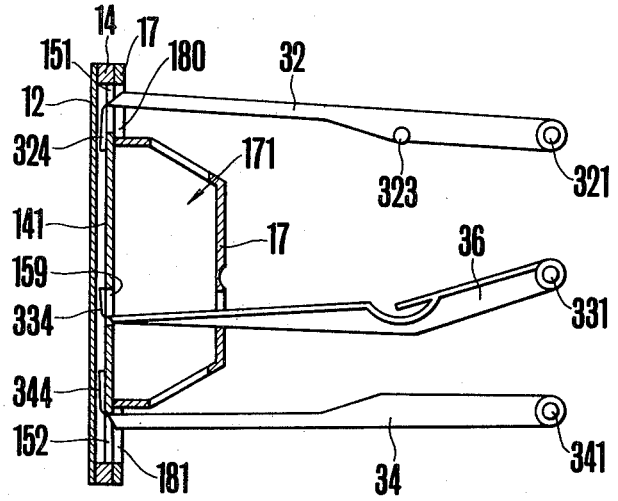
FIG. 8 is a longitudinal sectional view showing the operation of the shutter members for opening and closing the horizontal digit openings.
Figure 17:
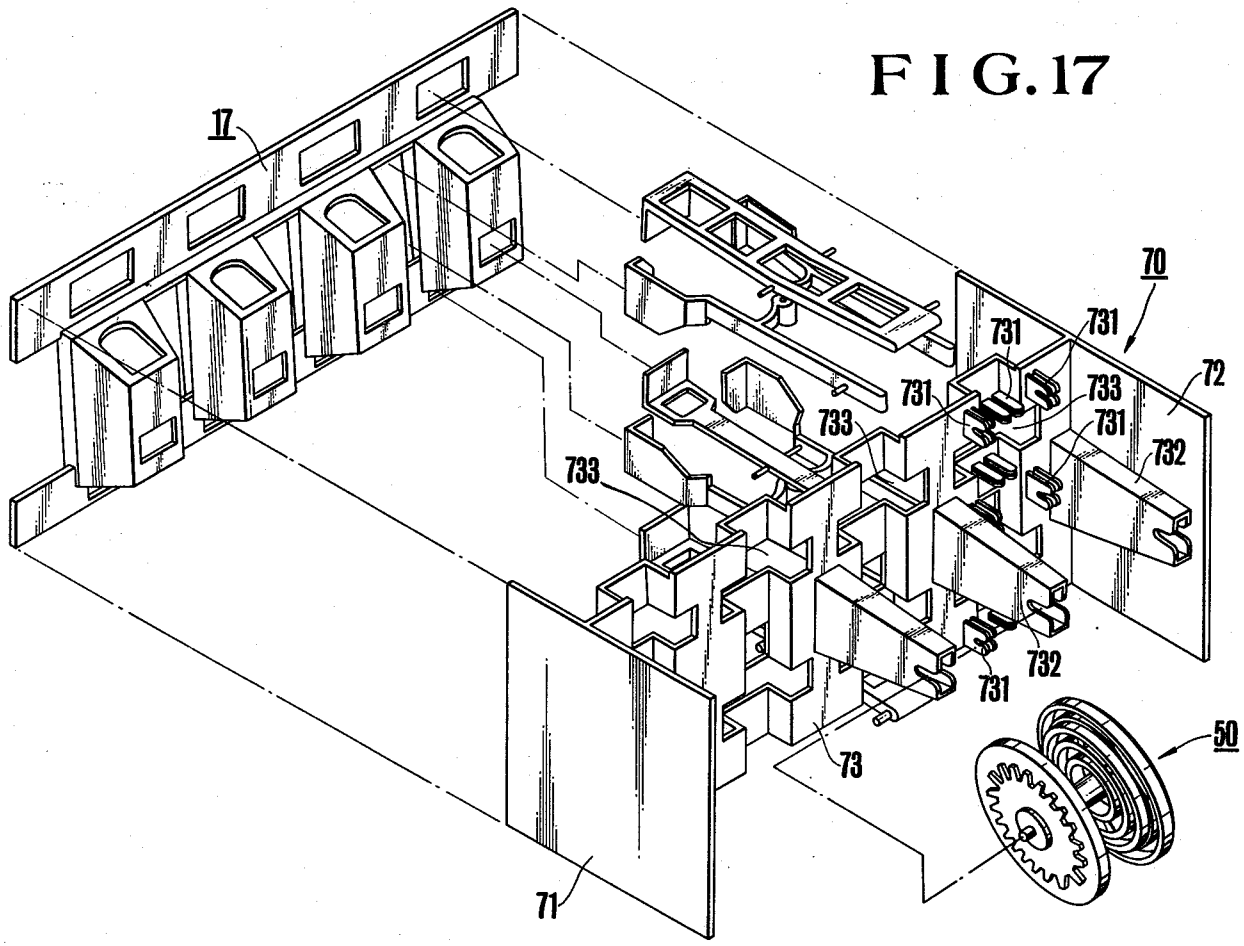
FIG. 17 is an exploded perspective rear view showing a modified display device.

As shown in FIG. 4, the lamp house block 17 is made of a milk white colored synthetic resin and provided with a plurality of lamp openings 171, 172, 173 and 174 respectively facing the rear surfaces of the minute shielding member 141, ten minutes shielding member 142, hour shielding member 144, and ten o'clock and PM, AM shielding member 145. A plurality of shutter guide grooves which are similar to the slots of the light diffusion plates are formed between lamp openings 171, 172, 173 and 174. The shutter guide grooves 188, 189, 190 and 191 of the lamp house block respectively corresponding to the slots 159, 160, 161 and 162 of the display substrate are formed in the rear walls of respective lamp house block. The walls 192 and 193 of the shutter guide groove 177 that separates the ten minutes lamp opening 172 and the hour lamp opening 173 are respectively provided with notches 194 and 195 extending toward the rear side. These notches 194 and 195 receive the legs 167 and 168 on the rear surface of the colon shielding member 143 of the light diffusion plate 14. In the fabricated condition of the display device assembly B the side edges of the legs 167 and 168 respectively engage the ten minutes lamp opening 172 and the hour lamp opening 173. On the upper walls of the lamp openings 171, 172, 173 and 174 are formed lamp insertion holes utilized to insert lamps of the illuminating device E to be described later, one in each cavity. These lamp insertion openings are shown in FIGS. 8 and 17. Perforations 196, 197, 198 and 199 respectively corresponding to the perforations 163, 164, 165 and 166 of the light diffusion plate 14 are formed near the four corners of the lamp house block 17.

Figure 1:
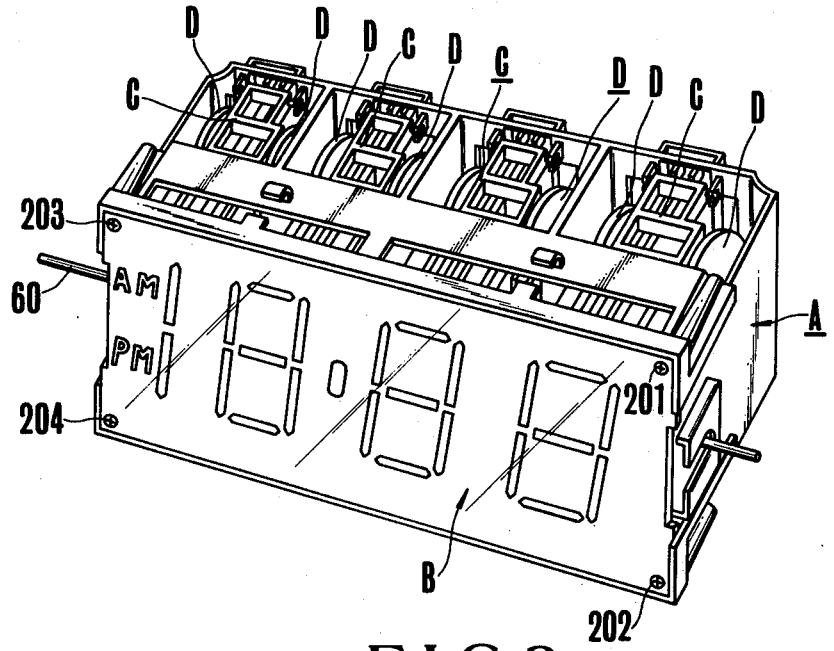
FIG. 1 is a general perspective view showing a display device provided for a shutter type digital clock embodying the invention.

The display device assembly B comprising the display substrate 12, the light diffusion plate 14, and the lamp house block 17 described above is secured to the front side of the frame 10 by set screws 201, 202, 203 and 204, as shown in FIG. 1.

The shutter unit C is interposed between the rear wall 101 provided with the plurality of bearing members and the display device assembly B. The minute, ten minutes and hour digits that display numerals by selectively opening and closing seven digit openings which are arranged in the form of a letter 8 will be described with reference to FIG. 6, in which reference characters designating various parts are common to all digits.

Figure 6:
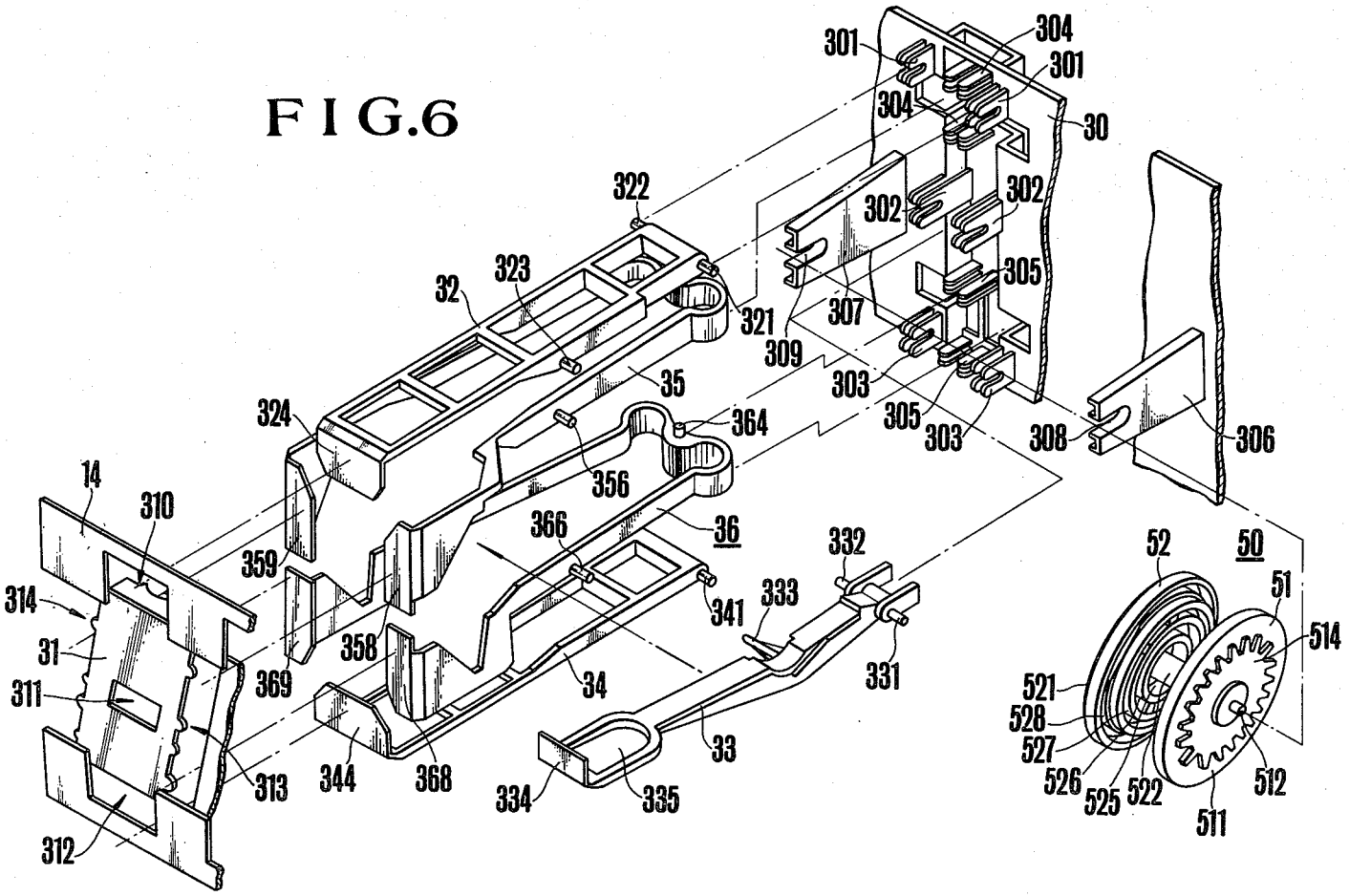
FIG. 6 is an exploded perspective view of the display device shown in FIG. 1 showing the construction of the shutter members, supports therefor, a cam member, and a frame of the display device.

As shown in FIG. 6, a plurality of bearing members already described in connection with FIG. 3 are formed on the rear wall 30 of the frame. More particularly, bearing members which are spaced in the horizontal direction and each comprising pair of bearing plates are secured on the upper portion of the rear wall 30 for forming a first shutter supporting member 301, the bearing plates being spaced in the horizontal direction. In the same manner at the middle portion and at the lower portion of the rear wall 30 are formed second and third shutter supporting members 302 and 303. The fourth and fifth shutter supporting members 304 and 305 are constituted by another pairs of bearing members which are spaced in the vertical direction and positioned on the center line of the first mentioned pair of bearing members. Furthermore, a pair of rotary cam supporting walls 306 and 307 are projected forwardly from the rear wall 30 on the opposite sides of a space bounded by said respective shutter supporting members. The rotary cam supporting walls have a length larger than that of the bearing members and are provided with open slots 308 and 309 extending in the fore and aft direction. A shielding member 31 of the light diffusion plate 14 is positioned to oppose respective shutter supporting members. Shutter guide openings 310, 311, 312, 313 and 314 are provided for the light diffusion plate 14. Thus, the rear end of the first shutter member 32 is pivotally mounted on the first shutter supporting member 301 and its fore end extends through the shutter guide opening 310 of the light diffusion plate 14. In the same manner, there are provided the second shutter member 33 supported by the second shutter supporting member 302 and guided by the shutter guide opening 311, the third shutter member 34 supported by the third shutter supporting member 303 and guided by the shutter guide opening 312, the fourth shutter member 35 supported by the fourth shutter supporting member 304 and guided by the shutter guide opening, and the fifth shutter member 36 supported by the fifth shutter supporting member 305 and guided by the shutter guide opening 313. These five shutter members constitute the shutter unit C.

All shutter members are made of material, having the same color as the display substrate 12, preferably black colored synthetic resin. The first and third shutter members 32 and 34 are constructed to have the same configuration. More particularly, these shutter members have a configuration corresponding to the upper and lower digit openings of a letter 8 shaped display digit opening and extend in the horizontal direction. On both sides of the rear ends of the shutter members 32 and 34 are provided pins 321, 322 and 341, 342 respectively engaging shaft openings of the shaft supporting members 301 and 303. A cam pin 323 adapted to cooperate with the rotary cam 50 to be described later is provided for the righthand side at about the center of the shutter member 32, whereas the shutter member 34 is provided with a cam pin, not shown, on its lefthand side. Furthermore, at the fore ends of the shutter members 32 and 34 are formed horizontal shutter pieces 324 and 344 which are bent to oppose with each other.

The second shutter member 33 also assumes a horizontal positon. Thus, the second shutter member is pivotally supported by the second supporting member 302. Pins 331 and 332 are formed on both sides of the rear end thereof and a cam pin 333 is integrally provided on the lefthand side of the central portion. A bent up shutter piece 334 is provided at the fore end. An opening 335 is formed near the shutter piece 334 to act as a lamp inserting opening. The shutter piece 334 extends through the guide groove 311 of the light diffusion plate 14 and located horizontally at about the central portion of the shielding member 31 to correspond to the horizontal central display digit opening described above.

The fourth shutter member 35 acts to open and close the left and right side digit openings at the upper end, whereas the fifth shutter member 36 acts to open and close the left and right side digit openings at the lower end. As above described, shutter members 35 and 36 shown in FIG. 10 have substantially the same configuration and the rear ends of the pairs of legs 351, 352, and 361, 362 are interconnected by their resilient members 353 and 363 thus forming a horizontal U shaped configuration. Pins 354, 355 and 364 and 365 are secured to the upper and lower surfaces of the central portions of the thin resilient members 353 and 363. These pins are received by the bearing members of the supporting members 304 and 305 to pivotally support the shutter members 35 and 36. Furthermore, cam pins 356 and 357, 366 and 367 are provided for the side surfaces of the central portions of the legs 351, 352 and 361, 362. The free ends of these legs are bent inwardly to oppose each other, thereby forming shutter pieces 358, 359, 368 and 369. Thus, near the fore end of each shutter piece is formed a slot and the thickness of the shutter piece beyond this slot is made thin, and this thin portion is bent. This construction of the shutter piece is advantageous in relation to the display device assembly B. As diagrammatically shown in FIG. 8, each shutter member is integrally formed thus reducing the number of the component parts and cost of assembling. Furthermore, since the shutter member interposed between the display substrate 12 and the light diffusion plate 14 is made thin it is possible to reduce the thickness of the display device assembly B. Since the shutter member has a certain degree of elaticity, it is not affected by dust entering between the display substrate and light diffusion plate 14. Moreover, the adhesion between the light diffusion plate 14 and the shielding member can be improved thereby preventing distortion of the display digit openings.

Figure 11:
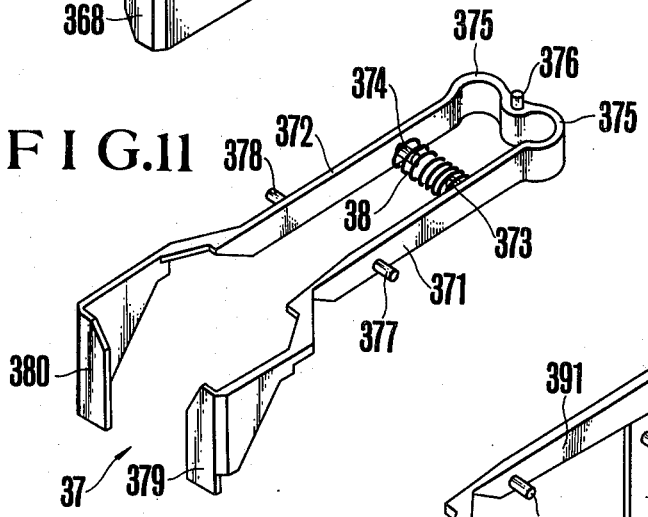
FIG. 11 is a perspective view of another example of the shutter member adapted to open and close the vertical digit openings shown in FIG. 10.

The shutter members, especially the fourth and fifth shutter members 35 and 36 may be replaced by a modified shutter member 37 shown in FIG. 11. The shutter member 37 is provided with a pair of opposing guide pins 373 and 374 on the inner surfaces of the legs 371 and 372 at a point near its rear end and a compressed coil spring 38 is interposed between the pins. The construction of the pin 376, cam pins 377 and 378, and shutter members 379 and 380 is the same as the construction described above. The purpose of the coil spring 38 is to assist the thin connecting member 375 and the operation thereof will be described later in connection with the cam control mechanism D.

Figure 12:
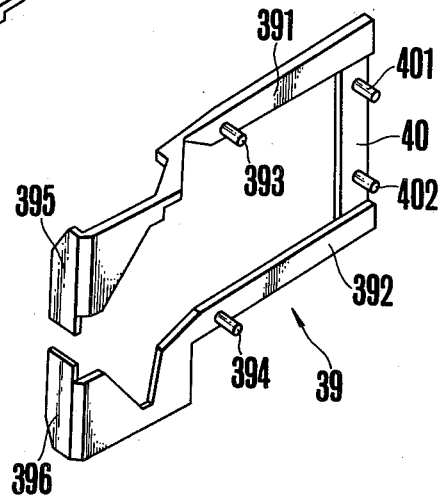
FIG. 12 is a perspective view showing the shutter member for opening and closing the ten o'clock digit opening.

The shutter member 39 of the ten o'clock shutter unit is shown in FIG. 12. According to this invention the shutter member 39 is formed by utilizing the fourth and fifth shutter members 35 and 36 of the lower digit shutter unit. More particularly, the righthand sides of the fourth and fifth shutter members 35 and 36 are cut away to form legs 391 and 392 which are integrally connected by a connecting member 40 having a pair of pins 401 and 402 on the righthand side. The shutter member 39 is further provided with cam pins 393 and 394, and shutter pieces 395 and 396. This shutter member can be applied to the shutter unit of the ten o'clock display member with two vertical segment openings arranged in the form of letter "1". Accordingly, it is not necessary to prepare a special metal mold for forming the shutter member 39. The shutter pieces 395 and 396 of the shutter member 39 extend through the shutter guide groove 178 of the lamp house block 17 and the guide groove 149 of the light diffusion plate 14 into the space between its ten o'clock shielding member 145 and the ten o'clock display member 125 of the display substrate 12.

Figure 13:
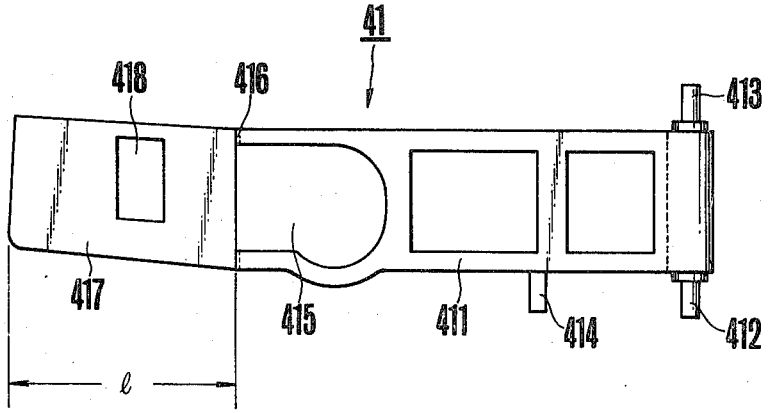
FIG. 13 is an developed plan view showing a shutter member adapted to open and close the AM, PM display letter openings.

FIG. 13 shows the AM, PM shutter member 41 which extends in the horizontal direction. Pins 412 and 413 are formed on both sides of rear end of the leg 411 and a cam pin 414 is formed on the righthand side at the central portion of the leg 411. A V shaped groove 416 communicating with the lamp inserting opening 415 is provided for the leg 411 and the portion beyond this groove 416 is constructed to form thin shutter piece 417. The length l of the shutter piece 417 corresponds to that of the AM, PM display member 204 formed with "AM" and "PM" letter openings when shutter member 417 is combined with the shutter member 41. The shutter piece 417 is formed with a rectangular slot 418 having a dimension completely covering the "AM" letter opening of the AM, PM display member 204. Consequently, as will become clear from the following description of the operation the shutter piece 417 of the shutter member 41 cam swing in the vertical direction as viewed in FIG. 1. When the shutter member 41 is in its upper position the lower end of the shutter piece 417 is positioned above the "PM" letter opening whereas in the lower position the "PM" letter opening is covered but the slot 418 aligns with the "AM" letter opening.

Figure 14:
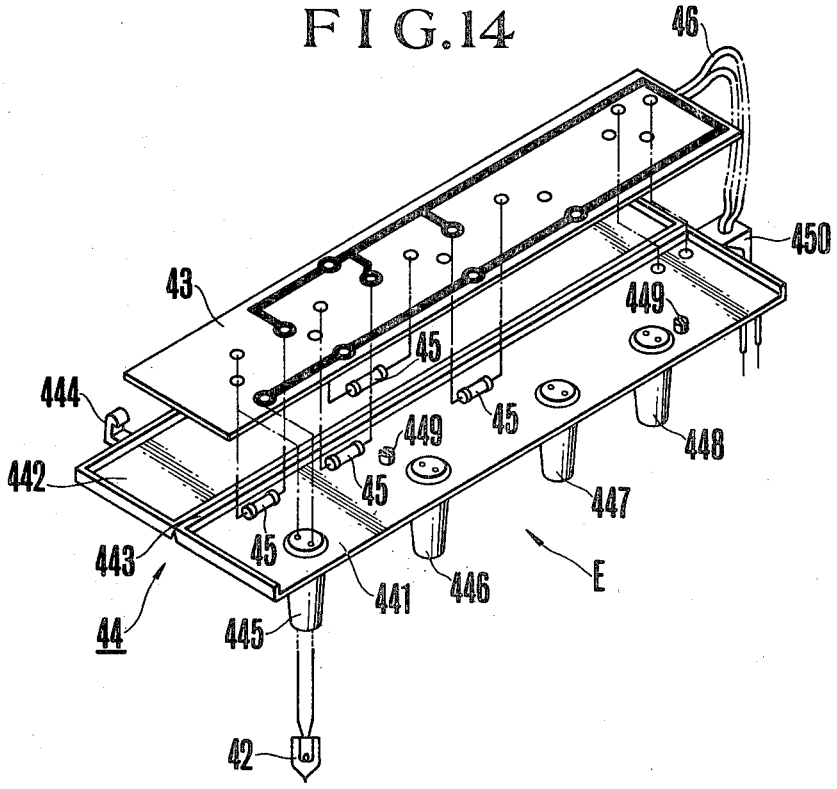
FIG. 14 is an exploded perspective view showing the illuminating device.
Figure 15:
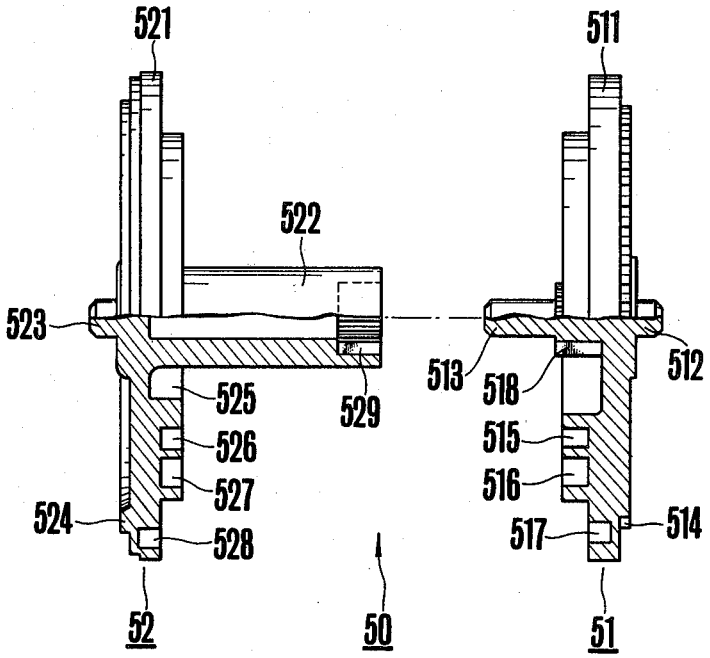
FIG. 15 is a partial sectional view showing the construction of a rotary cam.

The illuminating device E is shown in FIG. 14 and comprises a plurality of lamps 42 such as incandescent lamps or neon tubes respectively received in lamp openings 171, 172, 173 and 174 of the lamp house block 17, a printed substrate 43 to which the lamps are connected and a holder 44. Lamps 42 having bare lead wires are inexpensive but lamps may be received in sockets having insulated lead wires. Lamps 42 are connected to the printed circuit on the substrate 43 through resistors 45. The holder 44 may take the form of a closed box which contains the substrate 43 in the assembled state. The holder 44 is made of a synthetic resin and comprises a base portion 441 and a cover 442 which are connected together by a thin resilient connecting member 443 utilized to open and close the cover. Hooks 444 of a suitable number are provided along the periphery of the cover 442 for engaging the edge of the base portion 441 thus forming a closed box. The base portion 441 is integrally formed with a plurality of lamp supporting cylinders 445, 446, 447 and 448 which are arranged in the longitudinal direction of the base portion. Each supporting cylinder is constructed to receive lamp 42 from lower. A pair of perforations are formed through the base portion to pass lamp lead wires. A plurality of slitted pins 449 are secured to the base portion to be received in the corresponding perforations of the printed substrate 45 thus fixing the printed substrate to the base portion. A lead wire holder 450 is formed at one end of the base portion 441 for anchoring lead wires 46 extending from the printed substrate 45 and the lead wires are soldered to the printed circuit. As above described since the printed substrate 43 is secured to the base portion 43 of the holder 44 by means of pin 449 the cover 441 can be secured to the base portion 441 by the hooks 444. The fore end of the illuminating device E is supported by the projections 112 and 113 of the frame 104 whereas the rear end is supported by projections 114 and 115 of beam 105, thereby mounting the illuminating device on the frame 10. In the assembled state the supporting cylinders 445, 446, 447 and 448 extend through the grooves formed through the upper walls of respective lamp openings of the lamp house block thereby accommodating one lamp 42 in each of the lamp openings 171, 172, 173 and 174. Under this state, the supporting cylinders 445, 446, 447 and 448 extend through lamp guide openings of respective shutter members so as not to interfere with the operation of the shutter members. The cam control mechanism for controlling the position of the shutter members of respective shutter units is provided with a rotary cam 50 formed by combining a pair of cam plates for each display digit. The basic construction of the rotary cams is the same although the configuration of the cam grooves formed on the side surfaces of respective display digits differs slightly. With reference now to FIG. 15 the rotary cam 50 is constituted by combining first and second cam plates 51 and 52 made of a synthetic resin. The first cam plate 51 comprises a circular disc 511, stub shafts 512 and 513 on both side thereof, and a gear 514 secured to the righthand side of disc 511. Three concentric cam grooves 515, 516 and 517 are formed on the lefthand side of the disc, and a serration 518 is formed about the base portion of the stub shaft 513. Similarly, the second cam plate 52 is constituted by a circular disc 521 having the same diameter as the circular disc 511 and stub shafts 522 and 523 on both sides of the disc 521. A digit shift segment gear 524 is formed on a portion of the lefthand periphery of the disc 521 and concentric cam grooves 525, 526, 527 and 528 are formed on the righthand side surface. The stub shaft 522 takes the form of a hollow shaft having a relatively large diameter and a serration 529 is formed on the inner wall of the shaft bore. The first and second cam plates 51 and 52 are combined integrally by utilizing the serrations 518 and 519. The cam grooves are used to determine the positions of respective shutter members of the plurality of shutter units. For this reason, the first and second cam plates 51 and 52 must be combined integrally when they are positioned. Thus, some of the teeth of the serrations are removed thereby enabling to integrally combine both cam plates at the desired positions. The rotary cam 50 having two combined plates 51 and 52 has a sectional configuration of letter H. To mold a rotary cam having such complicated configuration it is necessary to use a metal mold having extremely complicated construction. Moreover, since the rotary cam includes such component parts as gear 514, segment gear 524, and several cam grooves which require extremely accurate finish dimensions, the metal molds utilized to mold these component parts are extremely expensive which renders it difficult to reduce the manufacturing cost of the shutter type digital clock. However, since the rotary cam is formed by assembling various component parts, inexpensive and simplified metal molds can be used, thus decreasing the cost of the shutter type digital clock.

Figure 7:
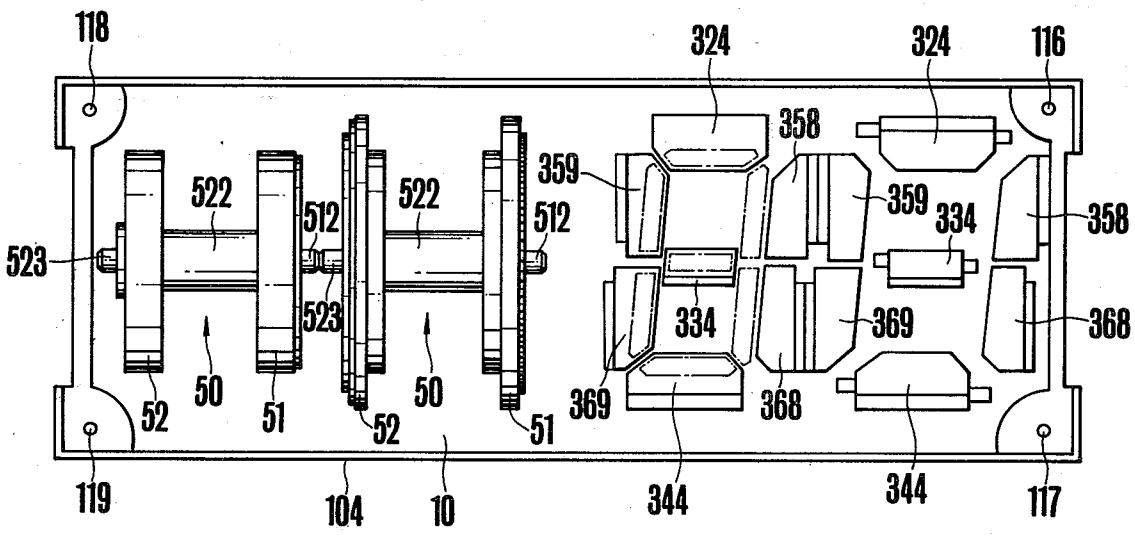
FIG. 7 is a front view showing the manner of combining various members shown in FIG. 6 with members shown in FIG. 4 removed.
Figure 9:
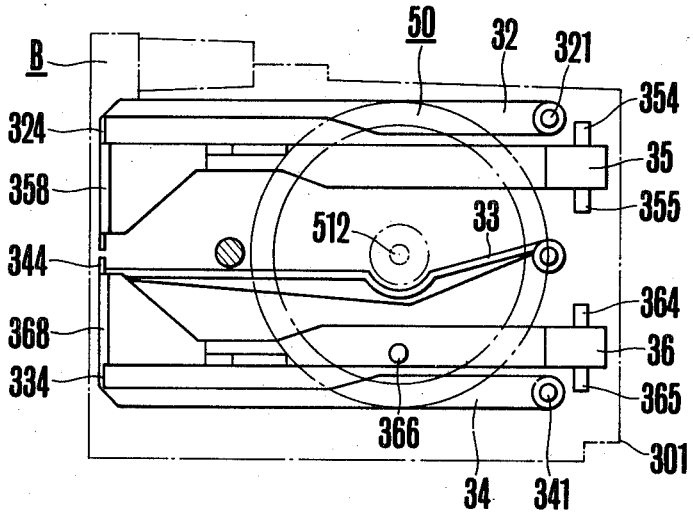
FIG. 9 is a longitudinal sectional view similar to FIG. 8 but with a shutter member for opening and closing the vertical digit openings and a rotary cam added.

The rotary cams described above are combined with other component parts as shown in FIGS. 6, 7 and 9 to prepare the assembly. More particulary, as shown in FIG. 6, the rotary cam 50 is supported by fitting the stub shafts 512 and 522 respectively in slots 308 and 309 of the supporting projections 306 and 307 secured to the rear wall 30 of the frame. This condition is best shown in FIG. 9. Thus, each shutter member of the shutter unit which is pivotally mounted on the bearing members projects from the rear wall 30 of the frame towards the display member assembly with its central portion of the legs interposed between the first and second cam plates. The cam pin 323 of the first shutter member 32 adapted to open and close the upper horizontal display segment opening is received in the outermost cam groove 517 of the first cam plate 51, the cam pin 333 of the second shutter member 33 adapted open and close the horizontal central display segment opening is received in the innermost cam groove 525 of the second cam plate 52, whereas the cam pin 343 of the third shutter member 34 adapted to open and close the horizontal lower display segment opening is received in the outermost cam groove 528 of the second cam disc 521. The righthand cam pin 356 of the shutter member 35 having a shutter piece 358 adapted to open and close the right upper display segment opening engages the central cam groove 516 of the cam disc 51 whereas the lefthand cam pin 357 of the shutter member 35 having shutter piece 359 adapted to open and close the left upper display segment opening engages outer second cam groove 527 of the second cam disc. The cam pin 366 of the shutter member 36 having a shutter piece 368 adapted to open and close the right lower display segment opening engages the innermost cam groove 515 of the first cam disc 51, whereas the lefthand cam pin 367 of the shutter member 36 having a shutter piece 369 adapted to open and close the left lower display segment opening engages the inner second cam groove of the second cam disc 52. Accordingly, the first, second and third shutter members 32, 33 and 34 swing in the vertical direction as viewed in FIG. 7, whereas the fourth and fifth shutter members 35 and 36 swing in the horizontal direction. In the condition shown in FIG. 7, only the righthand upper and lower display segment openings of the ten minutes display member 122 are opened but all other display segment openings are closed by shutter pieces associated therewith so that digit "1" is displayed under these conditions.

As above described, the first shutter member 32 selectively swung between upper and lower positions opens a display digit opening when it is in the upper position whereas closes the same when it is in the lower position. In the same manner, the second and third shutter members 33 and 34 which are selectively swung between upper and lower positions close display digit openings when they are in the upper positions and open the openings when they are in the lower positions. The fourth and fifth shutter members 35 and 36 selectively swung between left and right positions open display digit openings when their righthand shutter pieces 358 and 368 are in their righthand positions whereas close the display digit openings when they are in the lefthand positions. On the other hand, their lefthand shutter pieces 359 and 369 close the display digit openings when they are in the righthand position, but opens the display digit openings when they are in the lefthand position. Thus, respective shield portions of the light diffusion plate 14 can be seen through opened display digit openings but since the shutter pieces closing the display digit openings have the same color as the display substrate 12, no display is provided.

The construction comprising the combination of rotary cam 50 and shutter members is the same for each of the minute, ten minutes and hour digits each made up of a plurality of display digit openings which are arranged in the form of a letter 8. However, with regard to the ten o'clock digit comprising two display digit openings arranged in the form of a letter "1" and the AM, PM digit including vertically arranged "AM" and "PM" letters display digit openings, the first cam plate 51 drives the ten o'clock shutter member 39 while the second cam plate 52 drives the AM, PM shutter member 41. However, the driving arrangement of both shutter members 39 and 41 by the same rotary cam 50 is an efficient arrangement. More perticularly, as shown in FIG. 7, the rotary cam 50 controlling these digits is carried by the same shaft as the rotary cams controlling the other digits. Since it is not necessary to form supporting walls on the rear wall 30 for supporting the rotary cams for the ten o'clock digit and for the AM, PM digit, the construction of the frame is simplified.

Figure 10:
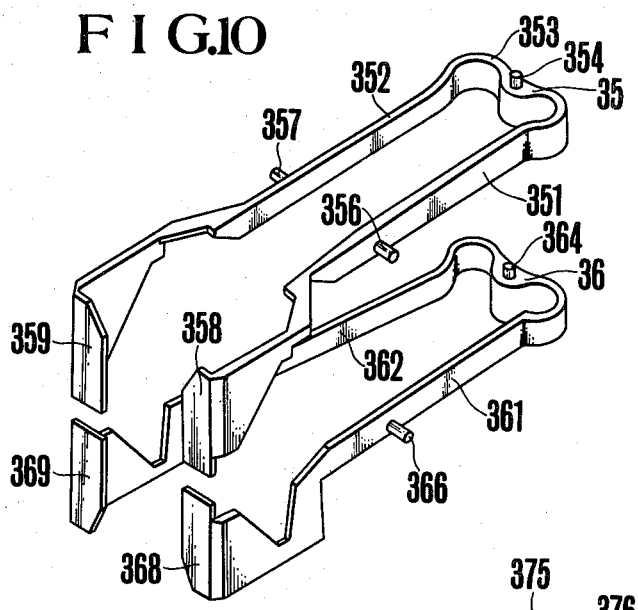
FIG. 10 is a perspective view showing the shutter member for opening and closing the vertical digit openings.

The combination of the rotary cam 50 and shutter members has the following additional features provided by the flexible thin portions 353 and 363 of the fourth and fifth shutter members 35 and 36 adapted to open and close the left and righthand display segment openings, as has been described with reference to FIG. 10. As has been pointed out hereinabove, since the first to third shutter members 32, 33 and 34 are swung in the vertical direction by rotary cam 50, it is possible to bias them to a predetermined direction by gravity. However, since the fourth and fifth shutter members 35 and 36 are constructed to be swung in the horizontal direction it is necessary to apply a suitable force to maintain their cam pins in engagement with cam grooves. According to this invention, the resiliency of the thin resilient portions 353 and 363 is used for this purpose. In the modified embodiment shown in FIG. 11, the compression spring 38 is used to supplement the resiliency of the thin resilient portions 353 and 363.

Figure 16:
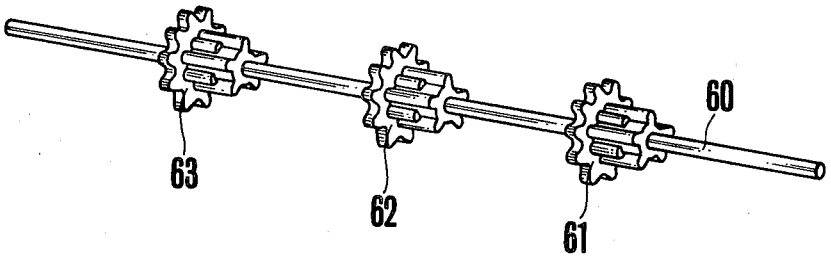
FIG. 16 is a perspective view showing a digit shift mechanism.

The cam control mechanism of the cam control member D is combined with the digit shift mechanism in a manner as shown in FIG. 16. More particularly, first to third pinions 61, 62 and 63 are rotatably mounted on shaft 60 with both ends journalled by slots 110 and 111 of the side walls 102 and 103. Each pinion is located between adjacent rotary cams for synchronously shifting the rotary cams to the upper orders, and constituted by a small gear and a large gear. The small gear is provided with alternate long and short teeth and normally locks the second cam plate 52 of the rotary cam of the lower order so that the small gear meshes the segment gear 524 of the second cam plate 52 when it rotates. On the otherhand, the large gear normally engages gear 514 of the first cam plate 51 of the rotary cam of the upper order. Consequently, when the segment gear meshes the small gear, the latter and the rotary cam 50 are stepwisely rotated by a definite angle.

As above described, almost of all component parts of the shutter type digital clock of this embodiment are molded from synthetic resins by using metal molds of simple construction whereby the cost of manufacturing the clock can be greatly reduced. Moreover, since the light diffusion plate 14 is made of a colored resinous material containing a phosphor pigment efficient display can be assured by the ground color of the light diffusion plate 14 even when the filament of an illuminating lamp 42 breaks. Although the number of the shutter members are larger than the conventional digital clock, this fact does not offset the advantages of this invention, since the shutter members have simple construction and can readily be mounted on the frame. This construction can also be used for mounting the rotary cam 50 of the cam control mechanism on frame 10. The fact that the fourth and fifth shutter members 35 and 36 have the same construction and that the ten o'clock rotary cam and the AM, PM rotary cam also have the same construction reduces the cost of manufacturing.

It should be understood that the invention is by no means limitted to the illustrated embodiments. For example, modified frame 10 shown in FIG. 10 can also be used in which lamp house block 17 and rotary cam 50 identical to those shown in FIG. 1 are also shown.

The frame 70 shown in FIG. 17 comprises a shutter supporting wall 73 extending between substantially middle points of side walls 71 and 72. On the front surface of the wall 73 are formed bearing members 731 for supporting shutter members of respective shutter units and supporting members 732 for supporting the rotary cam 50 of the cam control mechanism. Furthermore the supporting wall 73 is provided with a plurality of shutter guide openings 733 for guiding the shutter members, and the shutter members are provided with pins at about the middle portions which engage the bearing members and cam pins at the rear ends which engage the cam grooves of the rotary cam 50. In this modification, since the rotary cam 50 is disposed on the rear side of the frame it is possible to readily observe the engaging condition of the rotary cam 50 and respective shutter members, thus making easy to adjust after assembling.

What is claimed is:

1. A shutter type digital clock comprising a display substrate including hour, ten minutes and minute display members each constituted by a plurality of display digit openings which are arranged in the form of a letter 8 and a ten o'clock display member constituted by display digit openings which are arranged in the form of a letter "1"; a light diffusion plate located on the rear side of said display substrate and provided with a plurality of shutter guide openings corresponding to said respective display members; a lamp house block located on the rear side of said light diffusion plate and provided with a plurality of lamp openings corresponding to said respective display members; a plurality of lamps respectively accommodated in said lamp openings; a frame made of a synthetic resin and adapted to support said display substrate, said light diffusion plate and said lamp house block; a plurality of shutter units each including a plurality of shutter members located on the rear side of said lamp house block and extending to the front side of said light diffusion plate for selectively opening and closing said display digit openings; each shutter member being provided for each one of said display digit openings; and a plurality of cam control mechanisms associated with a synchronously operated digit shift mechanism and adapted to control the positions of respective shutter members of said shutter units; said frame including a pair of opposed side walls, and a supporting wall which is parallel with said display substrate and provided with a plurality of bearing members adapted to pivotally support said shutter members of said shutter units, and a plurality of bearing members adapted to rotably support rotary cams of said cam control mechanisms.

2. The shutter type digital clock according to claim 1 wherein said supporting wall is provided at a point a little ahead of the central portion of said pair of opposing side walls, said plurality of bearing members for supporting the shutter members of said shutter units are formed in the front surface of said supporting wall, and said plurality of bearings for supporting said rotary cam of said cam control mechanisms are formed on the rear surface of said supporting wall.

3. The shutter type digital clock according to claim 1 wherein said supporting wall comprises a rear wall interconnecting the rear ends of said pair of opposed side walls, and said shutter type digital clock further comprises a plurality of bearing members projecting into a space bounded by said supporting wall and said pair of opposed walls and adapted to support respective shutter members of said shutter units and another plurality of bearing members for supporting rotary cams of said cam control mechanism, all of said bearing members being integrally formed with said supporting wall.

4. The shutter type digital clock according to claim 3 wherein each one of said bearing members for supporting said shutter members and said rotary cams comprises a first bearing plate and a sencond bearing plate, said first bearing plate is formed with an open slot with an arcuate bottom, said second bearing plate is formed with a slot which is open at its outer end, and constituted by a tapered portion having a width decreasing toward the inner end, straight portions and arcuate portions interconnecting said tapered portion and said straight portions, said arcuate portions having the same radius of corvature and said arcuate bottom of said first bearing plate thereby forming a shaft opening by said arcuate portion and said arcuate bottom.

5. A shutter type digital clock comprising a display substrate provided with hour, ten minutes and minute display members each constituted by a plurality of display digit openings which are arranged in the form of a letter 8, and a ten o'clock display member constituted by display digit openings which are arranged in the form of a letter "1"; a light diffusion plate disposed on the rear side of said display substrate and provided with a plurality of shutter guide openings corresponding to respective display members; a lamp house block disposed on the rear side of said light diffusion plate and provided with a plurality of lamp openings corresponding to said display members; a frame for supporting said display substrate, said light diffusion plate and said lamp house block, said frame being made of a synthetic resin; a plurality of shutter units disposed on the rear side of said lamp house block, each shutter unit including a plurality of shutter members, each having a shutter piece extending toward the front face of each display digit opening for selectively opening and closing the same; synchronously operated digit shift mechanisms; a plurality of cam control mechanisms cooperating with said digit shift mechanisms for controlling the positions of respective shutter members of said shutter units; partition walls provided for said lamp house block for defining an hour lamp opening and a ten minutes lamp opening; said partition walls being provided with slots extending toward a front plate of said lamp house block, and a projection integrally formed on the back of said light diffusion plate; and a pair of projections extending through said slots to project their ends into said lamp openings, said projection engaging hour and minute display digit openings formed between said hour and ten minutes display members of said display substrate on the front side of said light diffusion plate.

6. A shutter type digital clock comprising a display substrate provided with hour, ten minutes and minute display members each constituted by a plurality of display digit openings which are arranged in the form of a letter 8, and a ten o'clock display member constituted by display digit openings which are arranged in the form of a letter 1; a light diffusion plate disposed on the rear side of said display substrate and provided with a plurality of shutter guide openings corresponding to respective display members; a lamp house block disposed on the rear side of said light diffusion plate and provided with a plurality of lamp openings corresponding to respective display members; a plurality of lamps respectively contained in said lamp openings; a frame made of a synthetic resin and supporting an assembly of said display substrate, said light diffusion plate and said lamp house block; a plurality of shutter units disposed on the rear side of said lamp house block; each shutter unit including a plurality of shutter members, each including a shutter piece extending toward the front face of a respective and associated display digit opening for selectively opening and closing the same; synchronously operated digit shift mechanisms; and a plurality of cam control mechanisms cooperating with said digit shift mechanisms for controlling the positions of respective shutter members of said shutter units; said display substrate and the respective shutter pieces of said shutter members of the shutter units being made of opaque synthetic resins of the same color and said light diffusion plate being made of a colored synthetic resin containing a phosphor pigment.

7. A shutter type digital clock comprising a display substrate provided with hour, ten minutes and minute display members each constituted by a plurality of display digit openings which are arranged in the form of a letter 8, and a ten o'clock display member constituted by display digit openings which are arranged in the form of a letter 1; a light diffusion plate disposed on the rear side of said display substrate and provided with a plurality of shutter guide openings corresponding to respective display members; a lamp house block disposed on the rear side of said light diffusion plate and provided with a plurality of lamp openings corresponding to said display opening; a plurality of lamps respectively contained in said lamp openings; a frame made of a synthetic resin for supporting said display substrate, said light diffusion plate and said lamp house block; a plurality of shutter units disposed on the rear side of said lamp house block; each shutter unit including a plurality of shutter members, each including a shutter piece extending toward the front face of a respective and associated display digit opening for selectively opening and closing the same; synchronously operated digit shift mechanisms, a plurality of cam control mechanisms cooperating with said digit shift mechanisms for controlling the positions of respective shutter members of said shutter units; partition walls provided for said lamp house block for defining said openings, said partition walls being provided with a plurality of slots at the upper portions thereof; and an illuminating device including a horizontal printed substrate removably mounted on said frame and adapted to support said lamps respectively inserted into said lamp openings through said slots.

8. The shutter type digital clock according to claim 7 wherein said illuminating device comprises a base provided with a plurality of cylindrical lamp holding members and a plurality of slotted pins, a cover for covering said base, and a printed substrate adapted to support said plurality of lamps and provided with a plurality of perforations corresponding to said slotted pins, said perforations receiving said slotted pins with said lamps respectively inserted into said cylindrical lamp holders when said printed substrate is mounted on said base.

9. A shutter type digital clock comprising a display substrate provided with hour, ten minutes and minute display members each constituted by a plurality of display digit openings which are arranged in the form of a letter 8 and a ten o'clock display member constituted by display digit openings which are arranged in the form of a letter "1"; a light diffusion plate disposed on the rear side of said display substrate and provided with a plurality of shutter guide openings corresponding to respective display members; a lamp house block located on the rear side of said light diffusion plate and provided with a plurality of lamp openings corresponding to respective display members; a plurality of lamps respectively contained in said lamp openings; a frame adapted to support said display substrate, said light diffusion plate and said lamp house block; a plurality of shutter units disposed on the rear side of said lamp house block; each shutter unit including a plurality of shutter members, each having a shutter piece extending toward the front face of each display digit opening for selectively opening and closing the same; synchronously operated digit shift mechanisms; a plurality of cam control mechanisms cooperating with said digit shift mechanisms for controlling the positions of respective shutter members of said shutter units; each one of said shutter units including seven shutter members for each digit and made of a synthetic resin to independently open and close the display digit openings of said hour, ten minutes and minute display members and one shutter member made of a synthetic resin for opening and closing the display digit openings of said ten o'clock display member; and a plurality of bearing members integrally formed on a supporting wall parallel with the rear surface of said lamp house block and forming a portion of said frame for pivotally supporting said shutter members independently.

10. The shutter type digital clock according to claim 9 wherein each one of said shutters is made of a synthetic resin and provided with a pair of parallel legs, vertical grooves near the free ends of said legs, relatively thin portions beyond said grooves, a pair of pin shafts adapted to engage a pair of opposing bearing members of said supporting wall, a pair of cam pins respectively connected to said plurality of cam control mechanisms, the outer ends of said legs being bent at about 90° to form shutter pieces.

11. The shutter type digital clock according to claim 10 wherein each one of the shutter members adapted to open and close left and righthand vertical display digit openings of the hour, ten minutes and minute display members further comprises a compression spring interposed between said legs.

12. The shutter type digital clock according to claim 10 wherein the inner ends of said legs are interconnected by a thin connecting member so that said shutter member generally takes the form of a letter U.

13. The shutter type digital clock according to claim 10 wherein each one of the shutter members adapted to open and close horizontal display digit openings of the hour, ten minutes and minute display members is provided with openings through said legs through which a lamp contained in the lamp opening of said lamp house block extends.

14. The shutter type digital clock according to claim 10 wherein said display substrate is provided with "AM" and "PM" letter display openings adjacent said ten o'clock display member, said display openings are in vertical alignment, and wherein the shutter member for opening and closing said "AM" and "PM" letter display openings and the shutter member for opening and closing the display digit opening of said ten o'clock display member are operated by said control mechanism and said first mentioned shutter member is provided with an opening having a height substantially equal to the height of said letters AM and PM.

15. A shutter type digital clock comprising a display substrate provided with hour, ten minutes and minute display members each constituted by a plurality display digit openings which are arranged in the form of a letter 8 and a ten o'clock display member constituted by display digit openings which are arranged in the form of a letter "1"; a light diffusion plate disposed on the rear side of said display substrate and provided with a plurality of shutter guide openings corresponding to respective display members; a lamp house block located on the rear side of said light diffusion plate and provided with a plurality of lamp openings corresponding to respective display members; a plurality of lamps respectively contained in said lamp openings; a frame made of a synthetic resin and adapted to support said display substrate, said light diffusion plate and said lamp house block; a plurality of shutter units disposed on the rear side of said lamp house block, each shutter unit including a plurality of shutter members, each having a shutter piece extending toward the front face of a respective and associated display digit opening for selectively opening and closing the same; synchronously operated digit shift mechanisms; and a plurality of cam control mechanisms cooperating with said synchronously operated digit shift mechanism for controlling the positions of respective shutter members of said shutter units; each cam control mechanism comprising a pair of cam discs provided with a plurality of annular cam grooves on the opposing side surfaces thereof, means for driving one of said cam discs by a cam disc at a lower order for causing said one cam disc to control the position of the shutter members adapted to open and close upper display digit openings and two display digit openings at the upper end and for causing the other cam disc to control the position of the shutter members adapted to open and close two display digit openings at the lower end as well as two vertical display digit openings.

16. The shutter type digital clock of claim 5 wherein all of the shutter pieces lie in substantially the same plane behind said display substrate.

17. The shutter type clock of claim 5 wherein each of the shutter pieces is moved to one of only two positions by the digit shift mechanisms to open and close the display digit openings.

* * * * *

UNITED STATES PATENT AND TRADEMARK OFFICE

CERTIFICATE OF CORRECTION

PATENT NO. : 4178752

DATED : Dec. 18, 1979

INVENTOR(S) : Hideo Umezaki, et al.

It is certified that error appears in the above-identified patent and that said Letters Patent are hereby corrected as shown below:

Col. 4, line 7, change "104" to -- 106 -- ;

Col. 4, line 12, change "104" to -- 106 -- ;

Col. 4, line 27, change "substrate a " to -- substrate a -- ;

Col. 14, line 19, change "corvature" to -- curvature -- ;

Signed and Sealed this

Fourth Day of November 1980

[SEAL]

*Attest:*

SIDNEY A. DIAMOND

*Attesting Officer*

*Commissioner of Patents and Trademarks*